US008847715B2

(12) United States Patent
Wilson et al.

(10) Patent No.: US 8,847,715 B2
(45) Date of Patent: Sep. 30, 2014

(54) MULTI INTEGRATED SWITCHING DEVICE STRUCTURES

(71) Applicants: Kevin Wilson, Lake Forest, CA (US); Robert Tarzwell, Freeport (BS); Patrick McGuire, Oakland, CA (US)

(72) Inventors: Kevin Wilson, Lake Forest, CA (US); Robert Tarzwell, Freeport (BS); Patrick McGuire, Oakland, CA (US)

(73) Assignee: Telepath Networks, Inc., Raleigh, NC (US)

( * ) Notice: Subject to any disclaimer, the term of this patent is extended or adjusted under 35 U.S.C. 154(b) by 94 days.

(21) Appl. No.: 13/627,233

(22) Filed: Sep. 26, 2012

(65) Prior Publication Data

US 2013/0082807 A1 Apr. 4, 2013

Related U.S. Application Data

(60) Provisional application No. 61/626,650, filed on Sep. 30, 2011.

(51) Int. Cl.
*H01H 9/00* (2006.01)
*H01H 53/00* (2006.01)
*H01H 51/22* (2006.01)

(52) U.S. Cl.
CPC ..... *H01H 51/2281* (2013.01)
USPC ..... 335/205; 335/4; 335/5; 335/206; 335/207

(58) Field of Classification Search
CPC ..... H01H 2001/0042; H01H 2051/2218; H01H 51/01
USPC ..... 335/205–207, 4–5
See application file for complete search history.

(56) References Cited

U.S. PATENT DOCUMENTS

| | | | | |
|---|---|---|---|---|
| 3,264,424 | A * | 8/1966 | Baermann | 335/207 |
| 3,681,723 | A * | 8/1972 | Goll | 335/207 |
| 4,668,928 | A * | 5/1987 | Davis et al. | 335/79 |
| 5,329,520 | A | 7/1994 | Richardson | |
| 5,475,353 | A | 12/1995 | Roshen et al. | |
| 5,479,608 | A | 12/1995 | Richardson | |
| 5,552,756 | A | 9/1996 | Ushiro | |
| 5,629,918 | A | 5/1997 | Ho et al. | |
| 5,787,085 | A | 7/1998 | Fox | |
| 5,790,519 | A | 8/1998 | Hanson et al. | |

(Continued)

FOREIGN PATENT DOCUMENTS

| | | |
|---|---|---|
| KR | 10-2003-0028451 | 4/2003 |
| WO | WO 01/57899 A1 | 8/2001 |

OTHER PUBLICATIONS

Form PCT/ISA/210 in connection with PCT/US2010/042789 dated Feb. 25, 2011.

(Continued)

*Primary Examiner* — Mohamad Musleh
(74) *Attorney, Agent, or Firm* — Greenberg Traurig, LLP; Franklin D. Ubell

(57) ABSTRACT

A permanent magnet is pivotally mounted in a top spacer layer of a switching device and rests on a flex arm created in an underlying flex circuit layer. The underside of the flex arm rests on a thin bar formed in a lower spacer layer beneath which lies a base layer including an electromagnet. Activation of the electromagnet causes rotation of the flex arm to thereby close and open electrical contacts formed respectively on the underside of the flex arm and on the top surface of the base layer.

19 Claims, 14 Drawing Sheets

(56) References Cited

U.S. PATENT DOCUMENTS

| | | | | |
|---|---|---|---|---|
| 5,872,496 | A | 2/1999 | Asada et al. | |
| 5,982,746 | A | 11/1999 | Hanson et al. | |
| 6,016,092 | A | 1/2000 | Qiu et al. | |
| 6,069,540 | A | 5/2000 | Berenz et al. | |
| 6,084,281 | A | 7/2000 | Fullin et al. | |
| 6,094,116 | A | 7/2000 | Tai et al. | |
| 6,124,771 | A * | 9/2000 | Kim et al. | 335/4 |
| 6,169,469 | B1 | 1/2001 | Misumi et al. | |
| 6,310,426 | B1 | 10/2001 | Birchak et al. | |
| 6,310,526 | B1 | 10/2001 | Yip et al. | |
| 6,335,992 | B1 | 1/2002 | Bala et al. | |
| 6,388,359 | B1 | 5/2002 | Duelli et al. | |
| 6,469,602 | B2 | 10/2002 | Ruan et al. | |
| 6,469,603 | B1 | 10/2002 | Ruan et al. | |
| 6,472,074 | B2 | 10/2002 | Sugimoto | |
| 6,492,887 | B1 * | 12/2002 | Diem et al. | 335/78 |
| 6,496,612 | B1 | 12/2002 | Ruan et al. | |
| 6,535,663 | B1 | 3/2003 | Chertkow | |
| 6,542,379 | B1 | 4/2003 | Lauffer et al. | |
| 6,633,212 | B1 | 10/2003 | Ruan et al. | |
| 6,639,493 | B2 | 10/2003 | Shen et al. | |
| 6,653,929 | B1 | 11/2003 | Hu et al. | |
| 6,710,694 | B2 | 3/2004 | Matsuta et al. | |
| 6,785,038 | B2 | 8/2004 | Hichwa et al. | |
| 6,794,965 | B2 | 9/2004 | Shen et al. | |
| 6,812,814 | B2 | 11/2004 | Ma et al. | |
| 6,904,191 | B2 | 6/2005 | Kubby | |
| 6,947,624 | B2 | 9/2005 | Kubby et al. | |
| 7,023,304 | B2 | 4/2006 | Shen et al. | |
| 7,027,682 | B2 | 4/2006 | Ruan et al. | |
| 7,071,431 | B2 | 7/2006 | Ruan et al. | |
| 7,142,743 | B2 | 11/2006 | Bernstein | |
| 7,193,831 | B2 | 3/2007 | Anthony | |
| 7,215,229 | B2 | 5/2007 | Shen et al. | |
| 7,266,867 | B2 | 9/2007 | Shen et al. | |
| 7,327,211 | B2 | 2/2008 | Ruan et al. | |
| 7,342,473 | B2 | 3/2008 | Joung et al. | |
| 8,143,978 | B2 | 3/2012 | Shen | |
| 8,421,561 | B2 * | 4/2013 | Shinoura | 335/4 |
| 2002/0140533 | A1 | 10/2002 | Miyazaki et al. | |
| 2003/0011450 | A1 * | 1/2003 | Shen et al. | 335/78 |
| 2003/0043003 | A1 | 3/2003 | Vollmers et al. | |
| 2003/0151480 | A1 | 8/2003 | Orr | |
| 2004/0027218 | A1 * | 2/2004 | Stafford et al. | 335/78 |
| 2005/0047010 | A1 | 3/2005 | Ishiwata et al. | |
| 2005/0057329 | A1 | 3/2005 | Shen et al. | |
| 2005/0270127 | A1 | 12/2005 | Six | |
| 2008/0073163 | A1 * | 3/2008 | Weir et al. | 188/71.1 |
| 2010/0182111 | A1 | 7/2010 | Hagihara et al. | |
| 2010/0214044 | A1 | 8/2010 | Shen | |
| 2011/0037542 | A1 | 2/2011 | Page et al. | |
| 2012/0025934 | A1 * | 2/2012 | McGuire | 335/177 |
| 2012/0200377 | A1 | 8/2012 | Lee et al. | |

OTHER PUBLICATIONS

Form PCT/ISA/237 in connection with PCT/US2010/042789 dated Feb. 25, 2011.

PCT International Search Report and Written Opinion re PCT/US2012/057325, dated Mar. 20, 2013, 10 pages, mailed from the Korean Intellectual Property Office.

* cited by examiner

MULTI INTEGRATED SWITCHING DEVICE STRUCTURES

CROSS REFERENCE TO RELATED APPLICATIONS

This application is related to and claims the benefit of and priority to U.S. Provisional Application Ser. No. 61/626,650, filed Sep. 30, 2011, entitled "Multi Integrated Switching Device Structures," the contents of which is hereby incorporated herein by reference herein in its entirety.

FIELD

The subject disclosure relates to switching devices and more particularly to miniature switching device structures.

RELATED ART

Electromechanical and solid state switches and relays have long been known in the art. More recently, the art has focused on micro electromechanical systems (MEMS) technology.

SUMMARY

An illustrative embodiment of a switching device according to this disclosure uses only one small permanent magnet in a relay design, which is based on a set of shorting contacts on a flex printed circuit. The flex circuit with permanent magnet mounted thereon rotates about a pivot point to open or close electrical contacts. The flex circuit/magnet is pivotally mounted above a base which includes only a single soft iron core magnet, one coil, and a set of contacts, which may connect the tip and ring-in with the tip and ring-out. In one embodiment, the PCB which comprises the base/coil is a multilayer board, and the pivot arm may be a single layer flex. In one embodiment, when a power pulse is applied to the coil, one end of the coil will be north and the other end will be south, which makes the magnetic beam (flex arm plus permanent magnet), which has north facing down, flip to the south end of the coil. The permanent magnet is thereafter attracted to the soft iron core inside the coil, which holds the permanent magnet in place after the power pulse terminates. An advantage is gained with dual force being applied to the permanent magnet as one end is being repulsed and one end is being attracted.

DETAILED DESCRIPTION

Figure 1:
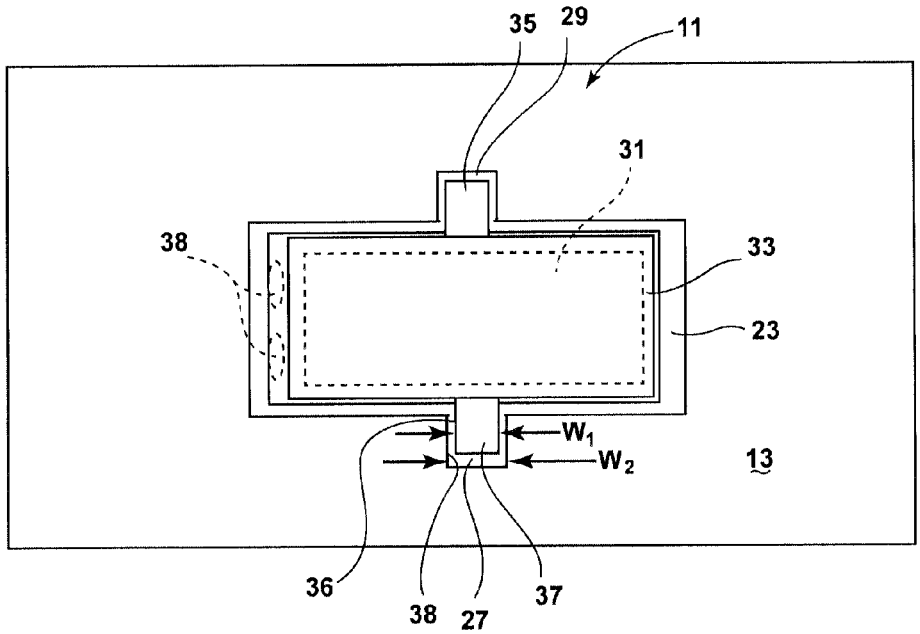
FIG. 1 is a top schematic view of a switching device or relay according to an illustrative embodiment.
Figure 2:
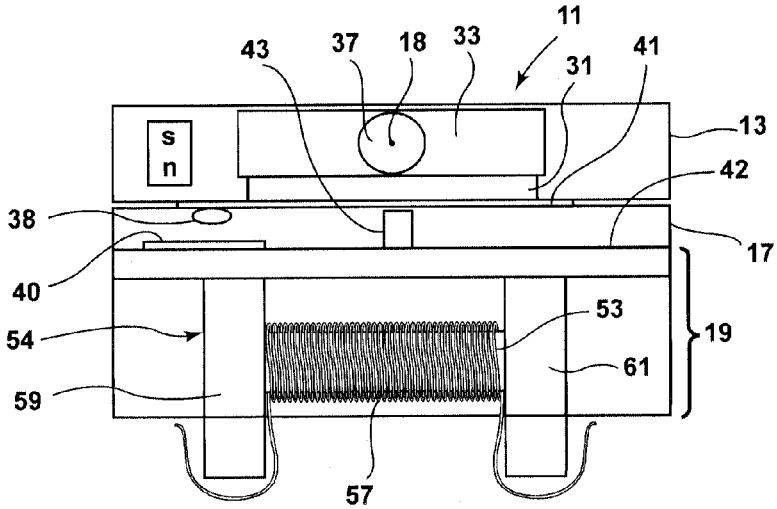
FIG. 2 is a side schematic view of the switching device or relay of FIG. 1.
Figure 3:
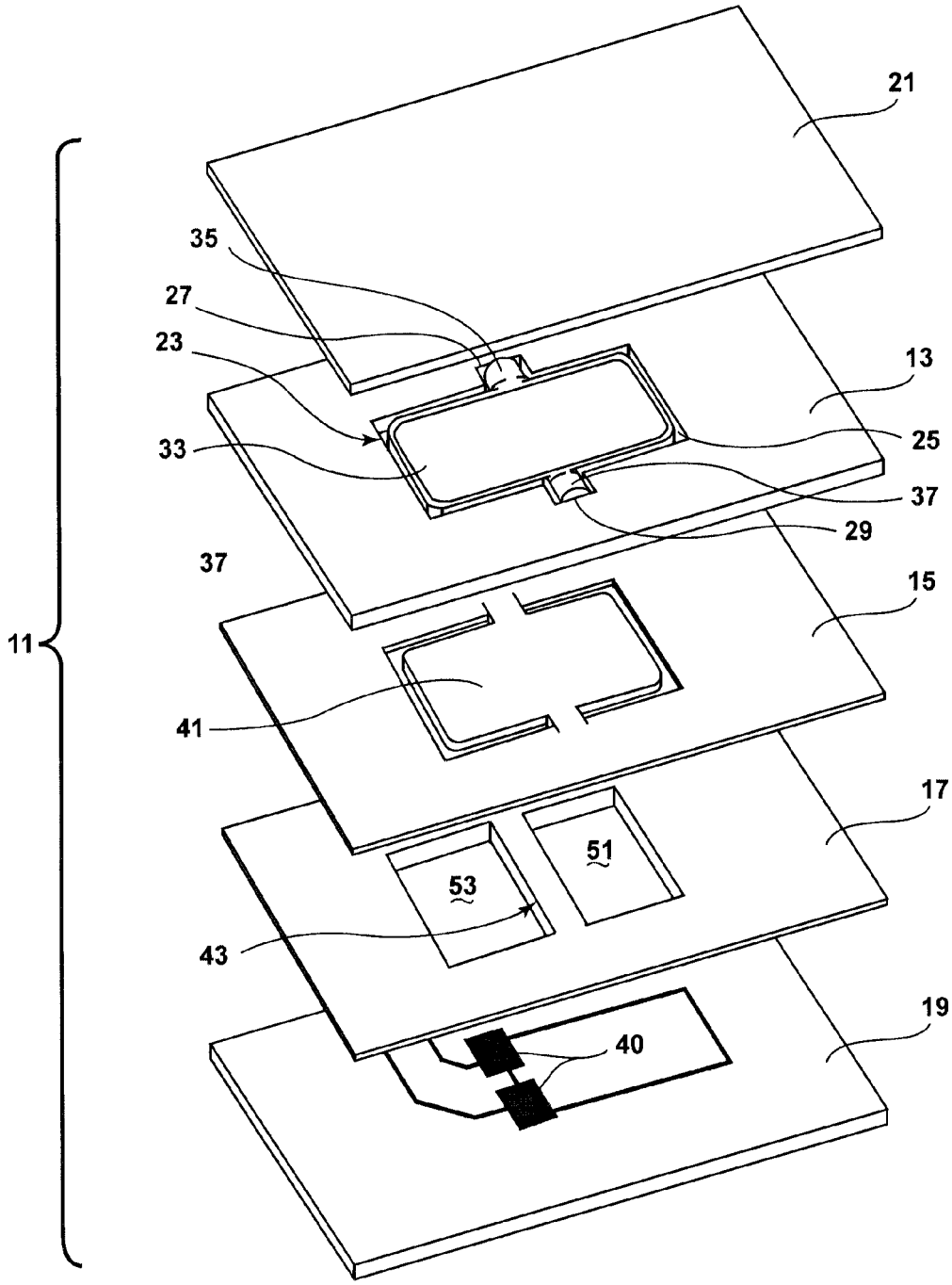
FIG. 3 is a side perspective view of a switching device or relay according to the illustrative embodiment.

An individual switching device or relay 11 according to an illustrative embodiment is shown in FIGS. 1-3. As shown, the device 11 includes an upper spacer 13, a flex circuit layer 15, a lower spacer 17 and a base 19. A cover 21 is attached over the upper spacer 13 and assists in closing the device and retaining interior components in place.

As shown, the upper spacer 13 has a cavity 23 formed therein which has a cross-shaped cross-section. The cavity 23 has a longitudinal channel 25 with centrally disposed side channels 27, 29 arranged perpendicularly to the longitudinal channel 25. In one illustrative embodiment, the upper spacer layer 13 is formed of conventional FR4 printed circuit board (PCB) material and may be 0.115 inches thick.

Figure 4:
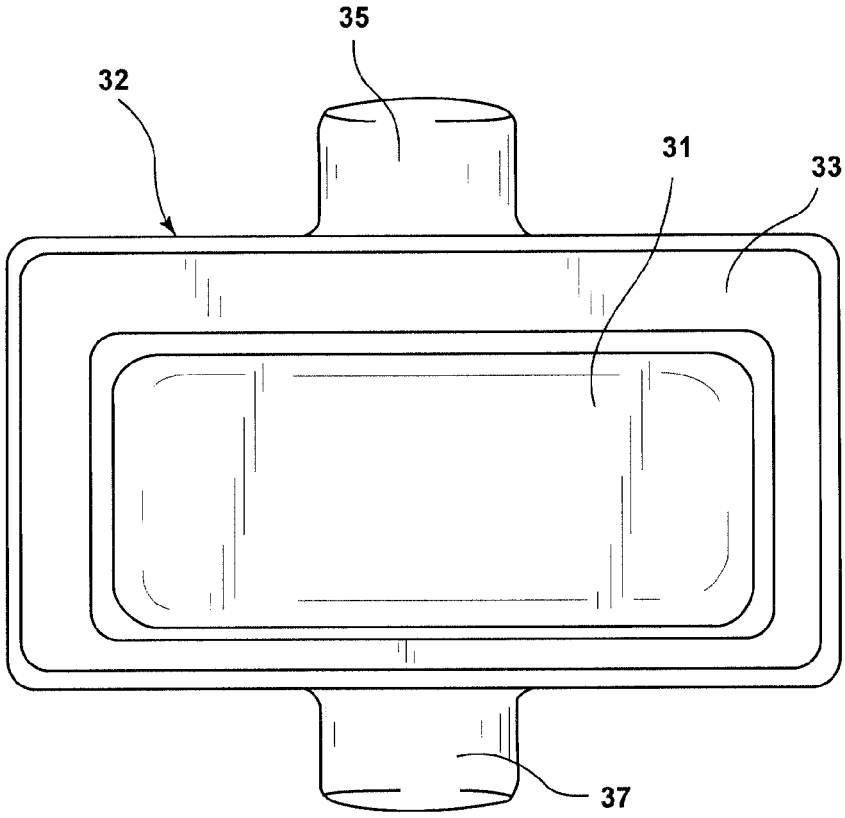
FIG. 4 is a bottom view of a permanent magnet and magnet holder according to an illustrative embodiment.

A permanent magnet 31 contained in a plastic case 33 resides in the cavity 23, as particularly illustrated in FIGS. 2-4. In one embodiment, the magnet 31 is glued into place in the plastic case 33. The plastic case 33 has five rectangular sides, an open end, and pivot arms 35, 37 formed on respective sides thereof. The pivot arms 35, 37, respectively reside in the centrally disposed side channels 27, 29 of the cavity 23. The component 32 comprising the plastic case 33 and magnet 31 "floats" in the cavity 23, such that the plastic case and magnet 33, 31 may pivot about a pivot point 18 in the upper spacer 17.

The exposed surface of the permanent magnet 31 rests on an underlying flex arm 41. When the permanent magnet 31 flips about the pivot point 18, it pushes down one side of the flex arm 41 and raises the other side. As illustrated in FIG. 2, in one embodiment, the permanent magnet 31 is arranged to protrude or extend slightly out of the open end of the plastic case 33.

In one illustrative embodiment, the lower spacer 17 may be formed of FR4 PCB material and may be, for example, 0.012 inches thick. A thin bar 43 on which the flex arm 41 rests is created in the lower spacer 17, for example by laser routing out, or otherwise establishing, openings 51, 53 through the PCB material. The openings 51, 53 allow the flex arm 41 to rotate therethrough to open or close electrical connections as described in more detail below.

Figure 5:
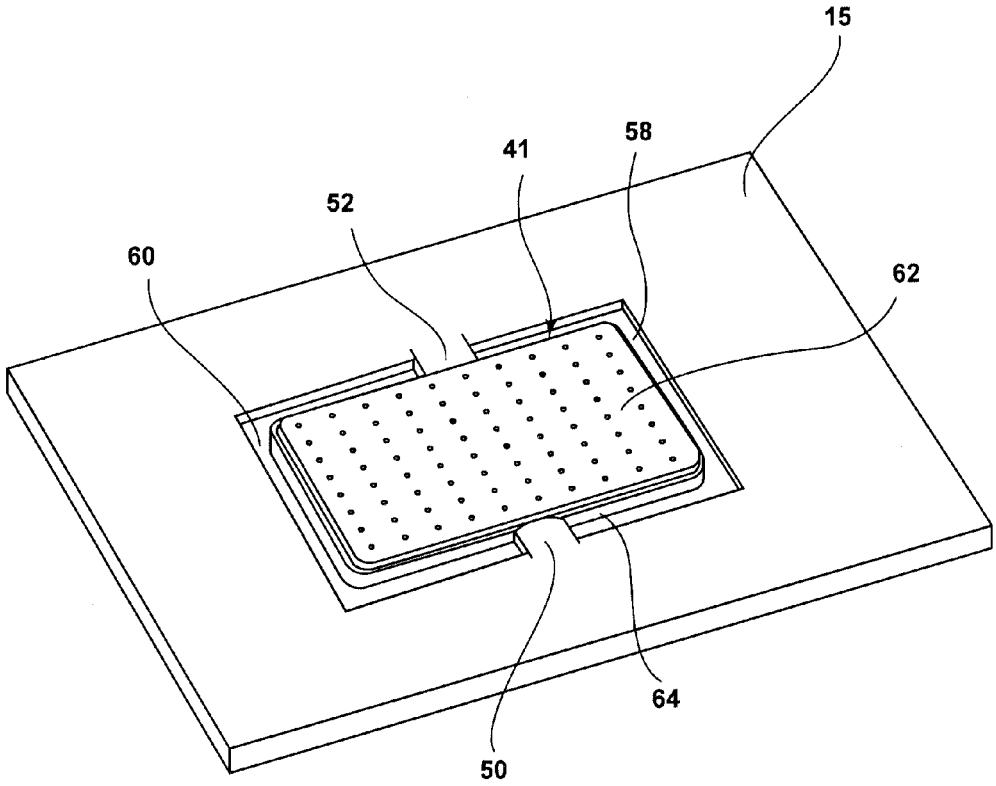
FIGS. 5 and 6 are top and bottom perspective views of a flex circuit layer according to an illustrative embodiment.
Figure 6:
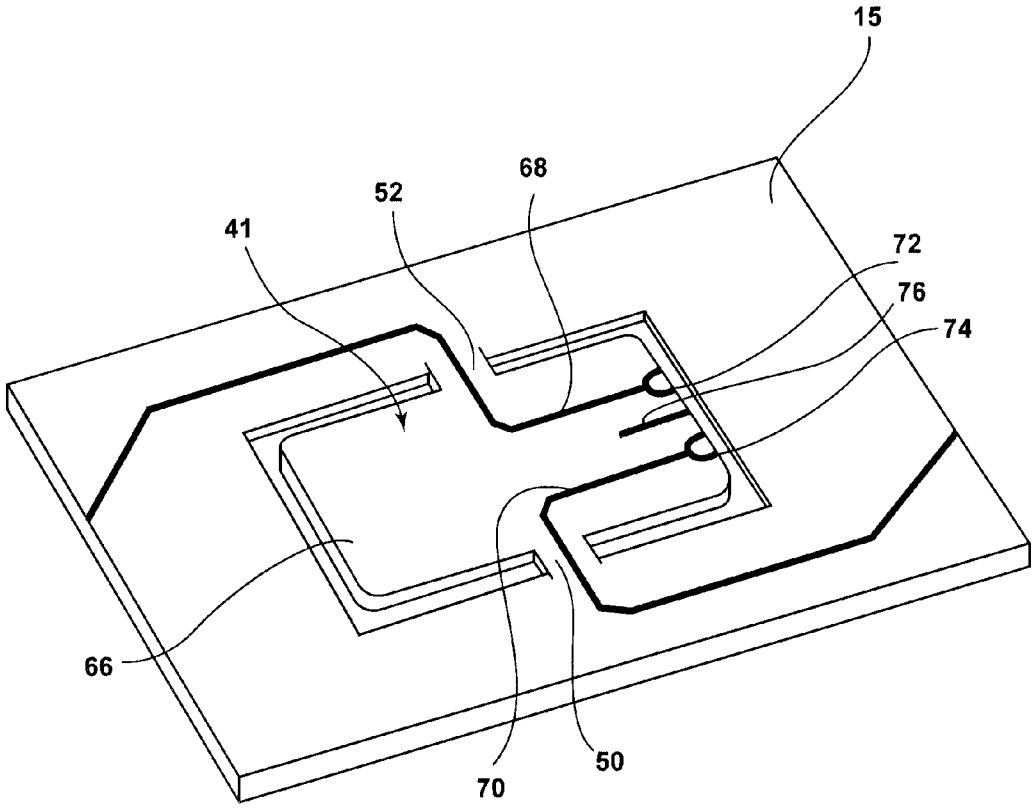
Figure 7:
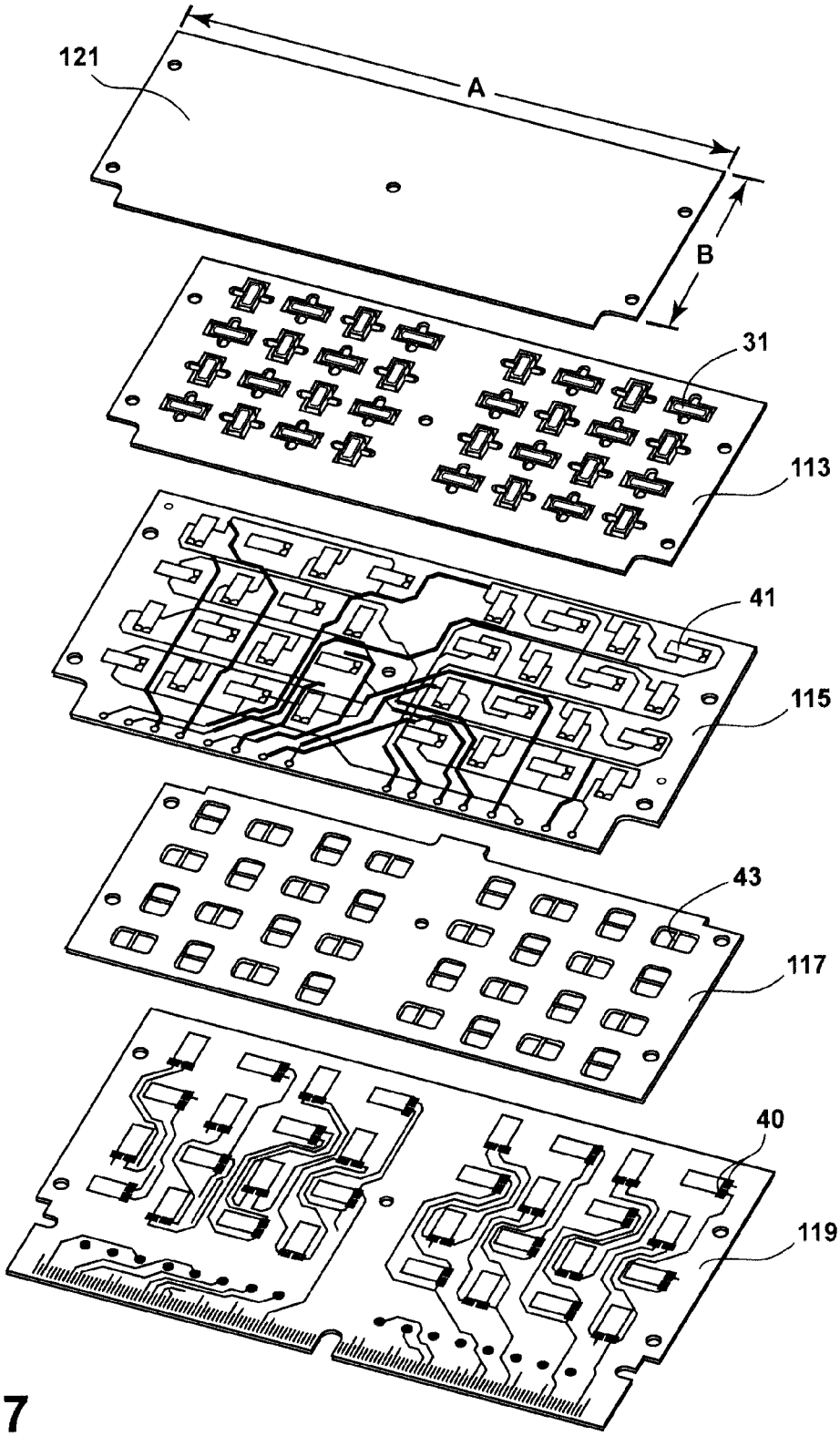
FIG. 7 is a top perspective view of a five component device containing 32 switching devices or relays configured according to an illustrative embodiment.

As shown in FIGS. 5 and 6, the flex arm 41 of the flex circuit layer 15 is suspended by respective pivot arms 50, 52, in an opening formed by first and second slots 58, 60, which may be formed by laser routing or other suitable means. The flex arm 41 is reinforced on its top side, for example, by a thin layer of copper plating 62 formed on a Kapton layer 64.

The back surface 66 of the flex arm 41 has signal traces 68, 70, of copper or another suitable conductor formed thereon, which run out the pivot arms 50, 52, to associated circuitry. The signal traces 68, 70 also provide bottom side reinforcement to the flex arm 41. Respective connecting pads 70, 72 are formed at one end of the flex arm 41 for purposes of, for example, connecting to cooperating tip and ring contacts. A longitudinal slot 76, for example, 0.010 inches long, may be cut between the connecting pad 72, 74, for example, using a laser to enhance electrical connectivity.

In one embodiment, the flex circuit layer 15 comprises a very thin layer of flexible Kapton base material, for example, 0.001 inches thick, with copper plating, for example, 0.0007 mils thick, on either side thereof. The copper plating may be etched to form the reinforcement layer 62, signal traces 68, 70 and contact pads 72, 74.

The base 19 of the device of FIGS. 1-3 further includes tip and ring contacts, e.g. 40 and an electromagnet 54. In the illustrative embodiment the electromagnet 54 may an "H"-shaped soft iron core as shown with a horizontal branch 57 formed between two vertical legs 59, 61. Further in the illustrative embodiment, conductive wire is wrapped around the horizontal leg 57 to form a conductive coil or winding 53 between the respective vertical legs 59, 61. In various embodiments, the base 19 may contain suitable conductor layers and vias suitably formed to conduct electrical signals from the top surface contacts, e.g. 40, of the base 19 through and out of the device, as illustrated in more detail below.

In operation of the illustrative embodiment, the permanent magnet 31 is arranged to pivot clockwise and counterclockwise at its center a few degrees. The permanent magnet 31 is arranged so that its north pole is facing down and its south pole is facing up. When the coil 57 is pulsed with current in a first direction, a north pole is created at one end of the iron core, e.g., at leg 61 and a south pole is formed at the other end, e.g., leg 59, causing the pivotally mounted permanent magnet 31 to rotate counterclockwise toward the south pole. Additionally, the north pole of the electromagnet at 61 repulses the north side of the permanent magnet 31. This action causes the flex arm 41 to rotate counterclockwise on the left side in FIG. 2, causing the contacts 38 on the underside of the flex arm 41 to contact the tip and ring contacts, e.g. 40, on the top surface 42 of the base 19, thereby, for example, respectively connecting the tip in and ring "in" with the tip out and ring "out" contacts. Once this closed contact position is reached, the attraction between the permanent magnet 31 and the soft iron core of the electromagnet 54 holds the flex arm 41 and contacts 38, 40 in the closed state.

To flip the rotating flex arm 41 to the other ("open") position, the coil 57 is pulsed with current in the opposite direction, causing a north pole to be formed at leg 59 and a south pole at leg 61, thereby rotating the flex arm 41 clockwise and opening the relay contacts. The bi-stable relay thus exhibits a teeter totter like action with two stable positions ("open" and "closed") and will remain at any one stable position until the coil 57 is pulsed in the opposite direction.

In the illustrative embodiment, the permanent magnet 31 and plastic case 33 may be shaped, dimensioned, and positioned such that an equal mass resides on either side of the pivot point 43. In one embodiment, the width W2 of the channels 27, 29 which receive the pivot pins or arms 35, 37 is made slightly wider than the width W1 of the pins 35, 37, allowing the case and magnet component 32 to slide forward a small amount, such that the magnet 31 first passes over center when the flex arm 41 rotates downwardly and then locks in place until an opposite polarity pulse is applied. Thus, for example, if the flex arm 41 rotates counterclockwise, the plastic case 33 and magnet 31 slide to the left in FIGS. 1 and 2 until the left edge 36 of the pin 37 abuts the left edge 38 of the channel 27. When an opposite polarity pulse is delivered, and the flex arm 41 rotates clockwise, the case 33 and magnet 31 move or slide to the right until the right edge of the pin 37 contacts the right edge of the channel 27. In one embodiment, the permanent magnet 31 may be 0.080" wide by 0.190" long by 0.060 inches thick and the widths W1 and W2 may be 60 and 100 mils respectively.

FIGS. 8 to 15 illustrate device layers which, when bolted, laminated, or otherwise attached together provide a layout of 32 devices 11 in a single package. In one embodiment, such a package may have dimensions A and B of 2 inches wide, 3.8 inches long. When assembled, the device may be 0.250 inches thick. The layers comprise a top layer 121, upper spacer 113, flex circuit layer 115, lower spacer 117 and base 119.

Figure 8:
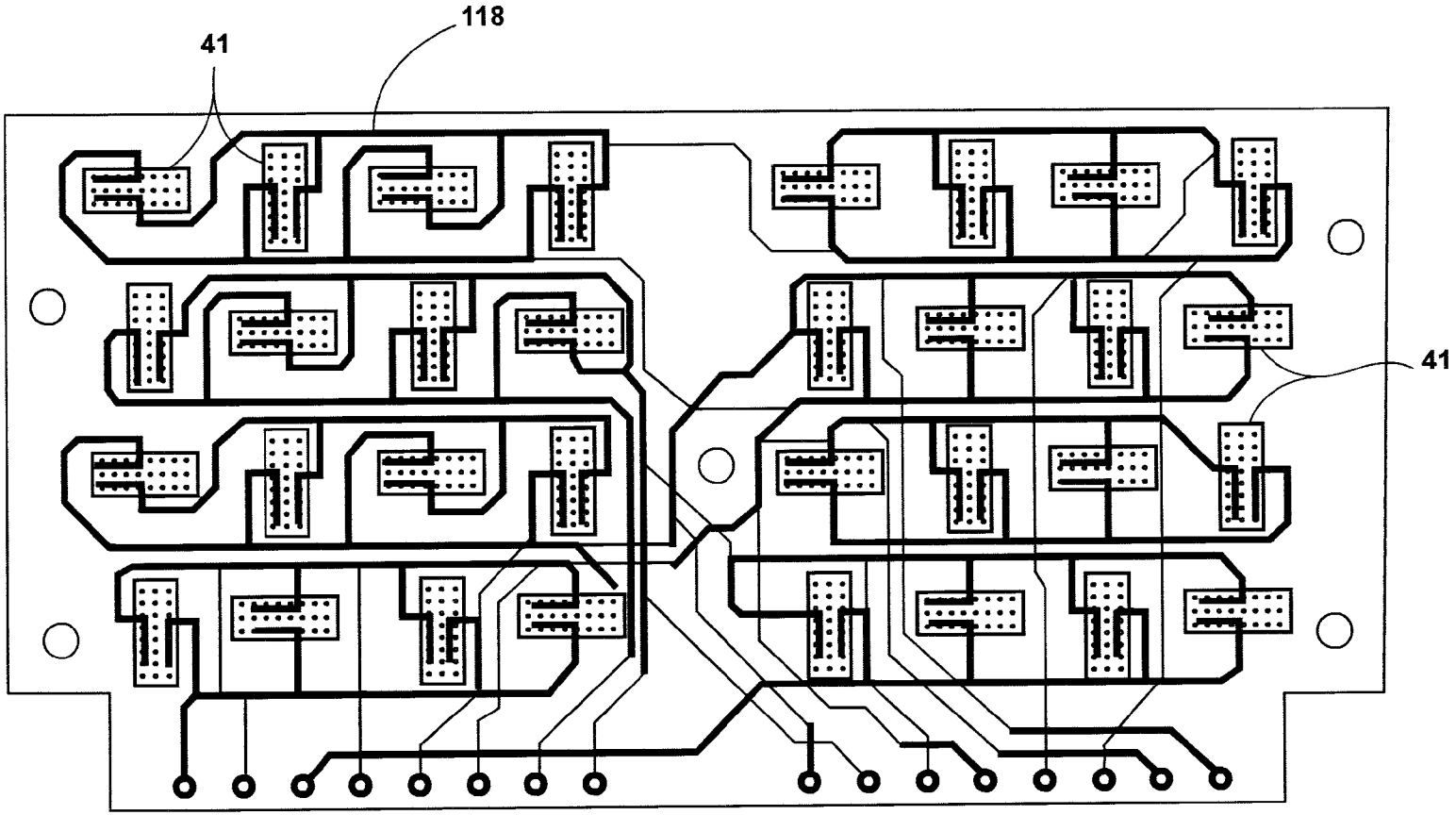
FIGS. 8 and 9 are respective perspective bottom and top views of a flex circuit component of the device of FIG. 7.
Figure 9:
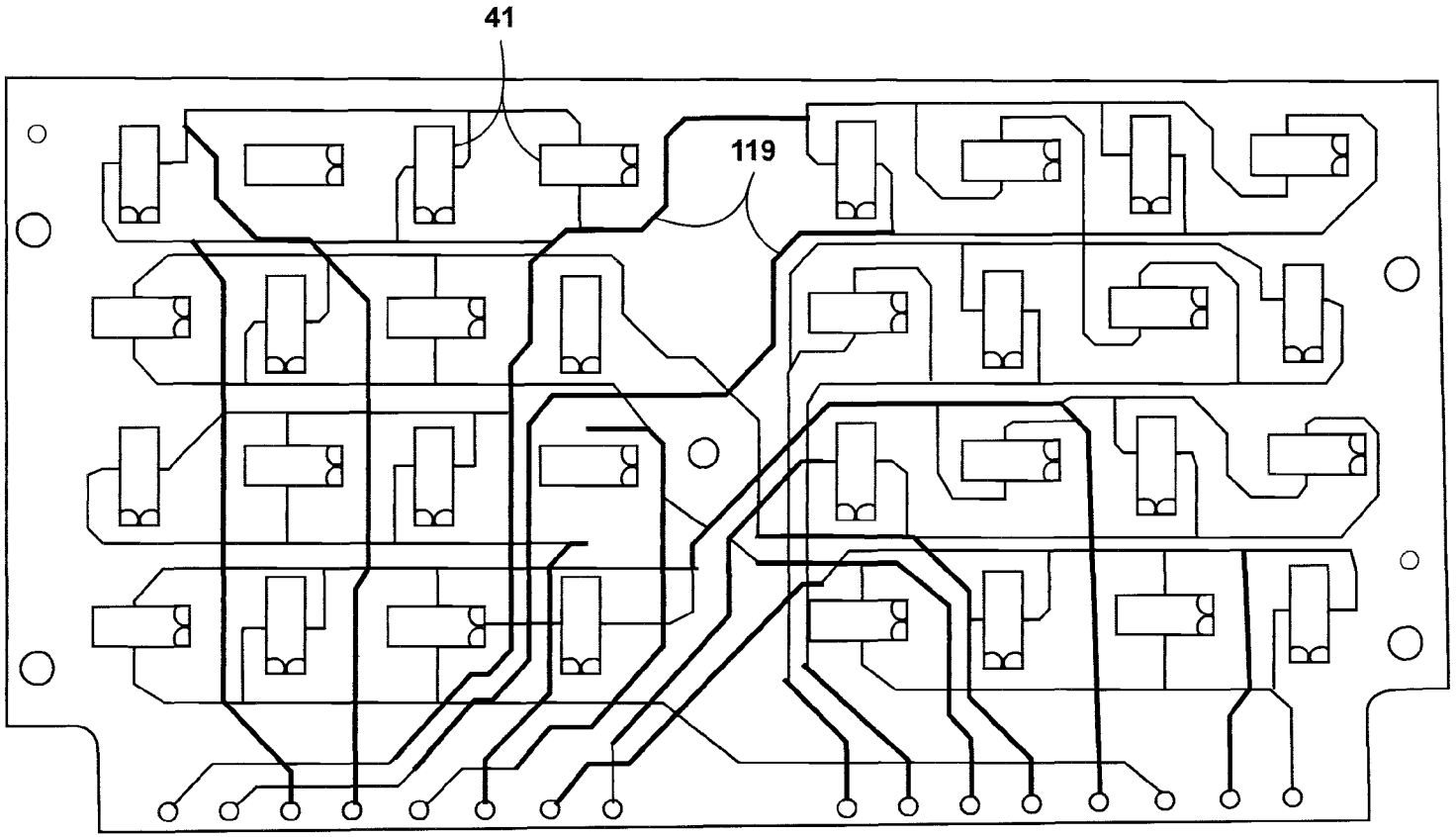
Figure 10:
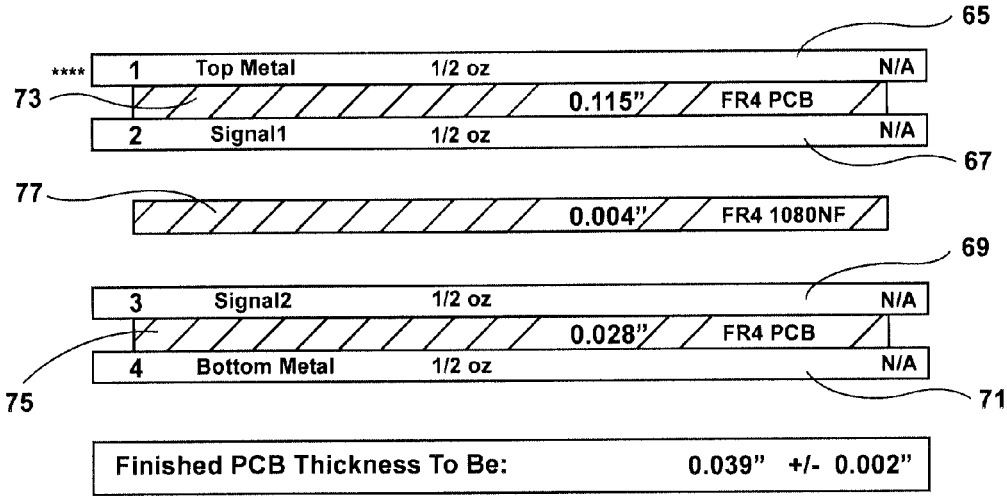
FIG. 10 is a schematic diagram illustrating construction of a base layer or board according to an illustrative embodiment.

FIGS. 8 and 9 illustrate one example of the conductor traces, e.g., 118, 119, created on the top and bottom surfaces of the flex layer 115. In one embodiment, these conductor traces serve to route the input signals (tip in and ring in) through a matrix of similar switches to the desired tip out and ring out channel.

Figure 11:
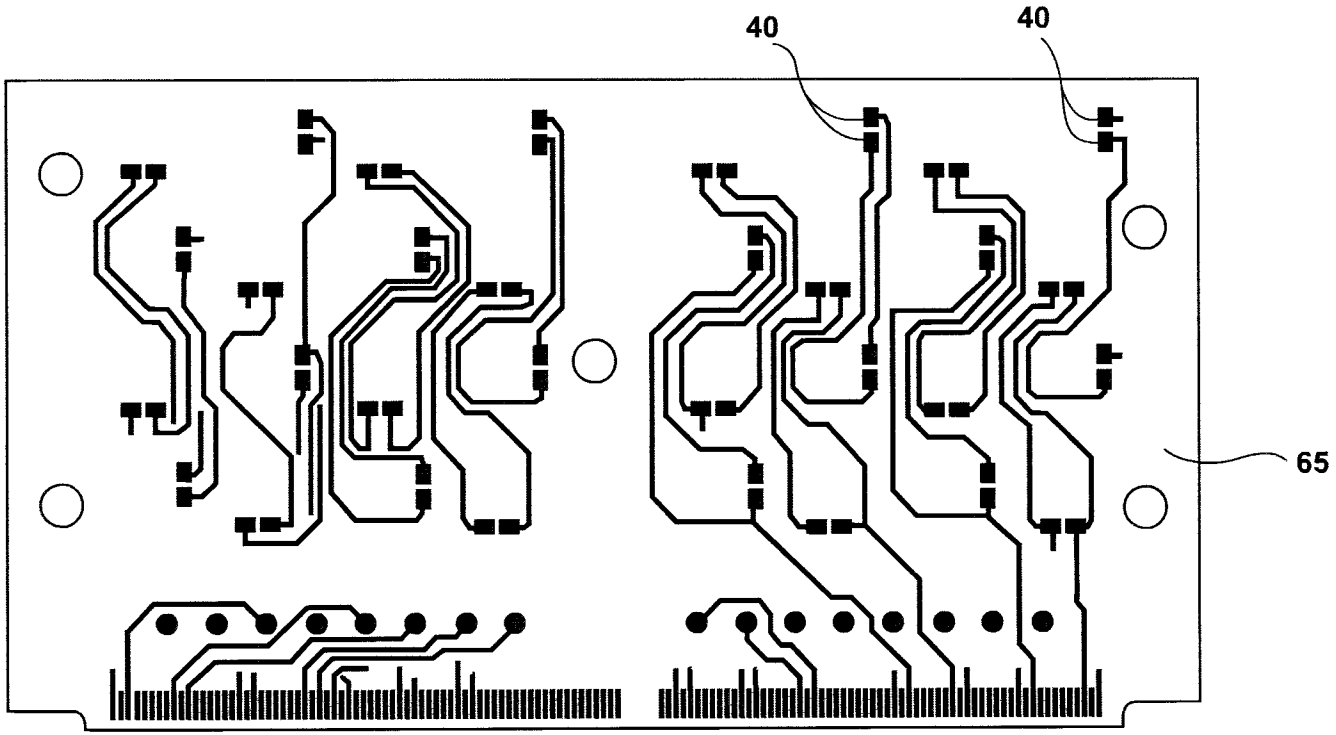
FIG. 11 is a top view of illustrating contact and conductor layout of a first layer of the base component.
Figure 12:
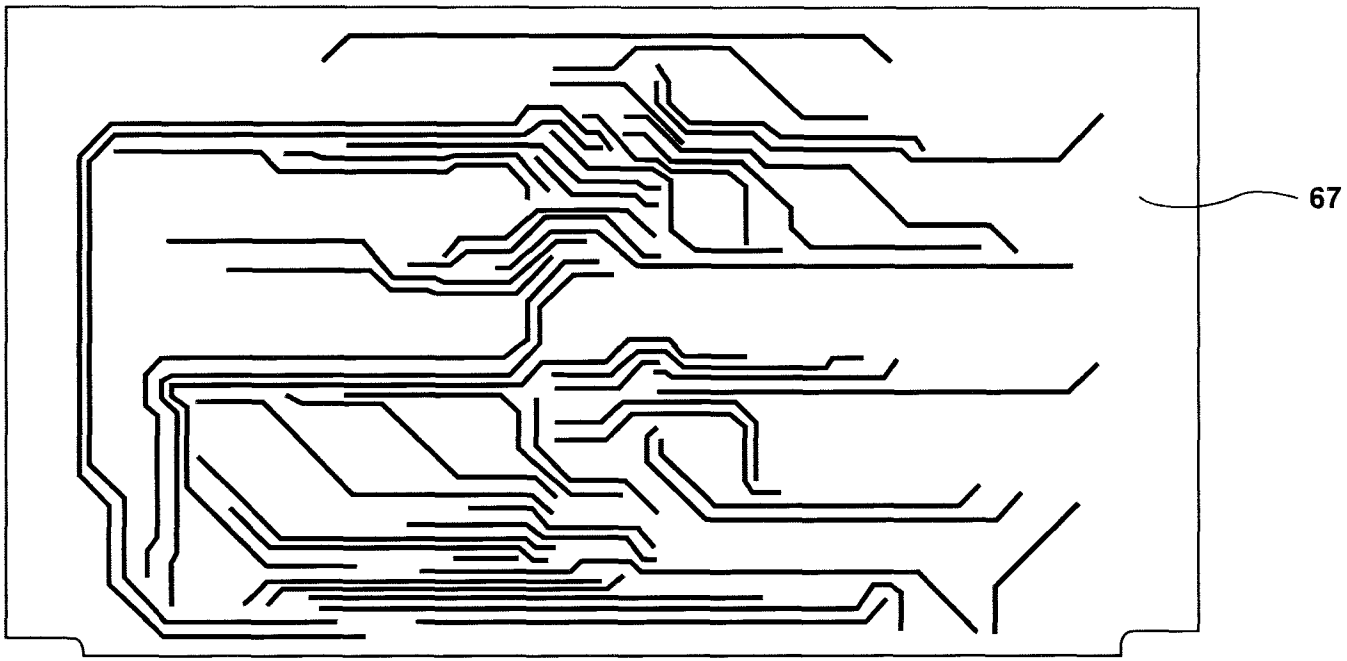
FIG. 12 is a top view of illustrating contact and conductor layout of a second layer of the base component.
Figure 13:
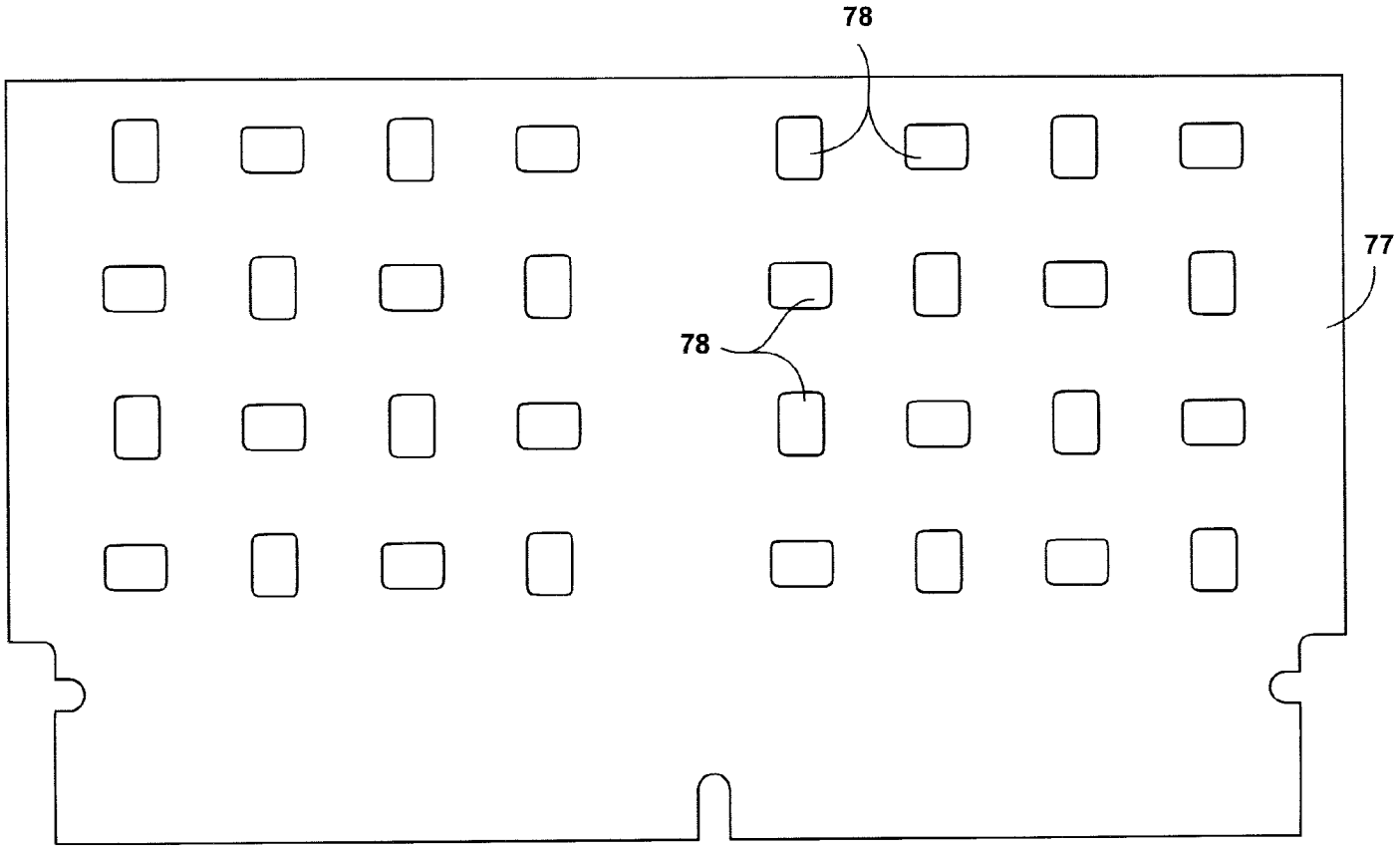
FIG. 13 is a top view of a pre-preg layer of the base.
Figure 14:
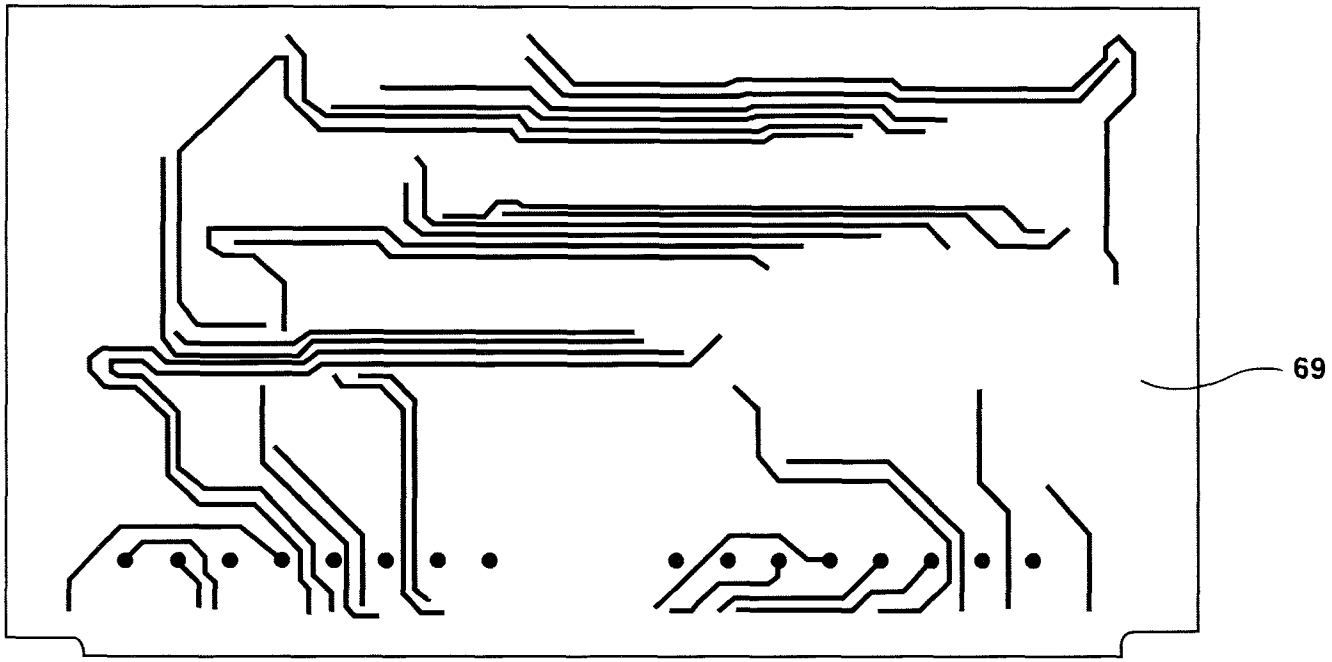
FIG. 14 is a top view of illustrating contact and conductor layout of a third layer of the base component.

In such an embodiment, the base 19 may comprise a number of layers as shown in FIG. 11. These layers include four metal (e.g. copper) layers—a top metal layer 65, a first signal layer 67, a second relay coil layer 69, and a bottom metal layer 71. The metal layers are separated respectively by FR4 PCB material layers 73, 75, and a pre-preg spacer layer 77. In an illustrative embodiment, the metal layers are appropriately etched to form the desired conductor patterns, and the layers are then laminated or otherwise attached together.

Figure 15:
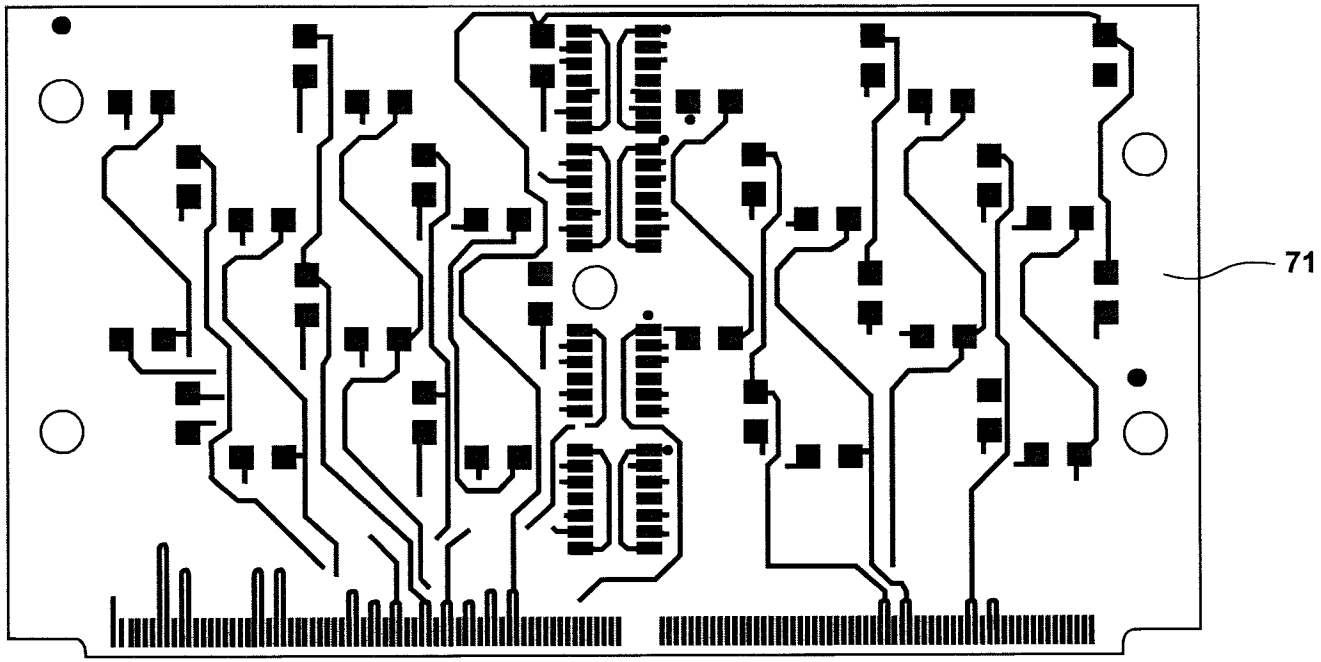
FIG. 15 is a top view of illustrating contact and conductor layout of a fourth layer of the base component.

The four metal conductor layers provided in the base 19 serve to supply power from the input pins of the device to the coils, e.g. 57 of each switching device and to route signals from the tip and ring contact pads, e.g., 40, FIG. 11, through and out of the device. Multiple layers are required in order to achieve all of the connections necessary within the confines of the dimensions of the package. An embodiment of a suitable top metal layer conductor pattern 81 is shown in more detail in FIG. 11. Examples of suitable conductor patterns 83, 85, 87 for the other metal layers are shown respectively in FIGS. 11, 14 and 15. An illustrative pre-preg layer 77 is shown in FIG. 15. It contains rectangular slots, e.g., 78, routed out in order to locate and glue the iron core/coil units in place. The electromagnets leads may be soldered in place on the bottom side of the base layer 19. In one embodiment, the base 19 may be on the order of 0.039 inches thick.

As noted above, in one embodiment, in the contact area, a slot may be added which separates the two contacts as they press down. This has the advantage that, if one pad is slightly higher, the pads will self adjust increasing chance for full contact.

While the embodiment just discussed employs 32 switching devices or relays, embodiments having, for example, 64 or 128 relays may also be fabricated. An advantage of the subject design is the construction is based on more main stream PCB technologies, which allows use of commodity PCBs rather than very high technology expensive PCBs. In alternate embodiments, various plastics could be used to fabricate the PCB's described herein, rather than FR4 material.

The device 11 is quite different in packing technology compared to some other designs. The device 11 has a multilayer base board and uses a plastic spacer 17 to position the magnet/flex 41 off the base board 19. The flex board 15 with the permanent magnet 31 in place is aligned to the base PCB 19 and spacer 17 and may be held together with a thermally welded plastic cap. The use of separate boards, e.g., 21, 13, 15, 17, 19 means an overall lower cost module, and when combined with the plastic cap technology enables higher volume manufacturing at a lower cost.

As discussed above, to enable a single permanent magnet design, a unique rotating magnet pivoting at its center a few degrees is employed. To enable the permanent magnet to rotate but yet remain fixed in the lateral position, a unique flex circuit with two pivot arms is employed. These arms can be tuned with laser slots and copper reinforcement to allow a relatively low strength magnet to be used. By utilizing a via pad cut in half on the flex, the edge contact area may be increased. The signal traces may run out the flex arms to the PCB, and the flex board is placed above the coil with spacers between. As the permanent magnet on the flex arm rotates with a pulse on the coil, the contacts connect the tip and ring in and out contacts. The coil has a soft iron core, which acts like a magnet amplifier increasing the coil output. The soft iron core is also used as a magnet latch, which keeps the permanent magnet and flex arm in one of two positions.

To increase the strength of the flex hinge area a thin bar 43 is advantageously added to the lower spacer 17. The thin spacer web 43 supports the magnet instead of stretching the flex over time. In one embodiment, to control the flex of the flex area with the contacts, 1 oz. copper may be used in the bottom contact area and 2 mil copper on top which is pitted with holes in the copper.

Those skilled in the art will appreciate that various adaptations and modifications of the just described illustrative embodiments can be configured without departing from the scope and spirit of the invention. For example, illustrative dimensions for various board or layer thicknesses are provided above but such dimensions may be different in other embodiments. Therefore, it is to be understood that, within the scope of the appended claims, the invention may be practiced other than as specifically described herein.

What is claimed is:

1. In a switching device or relay, the structure comprising:

a permanent magnet pivotally mounted in a top spacer layer;

a flex circuit layer disposed beneath the permanent magnet and comprising a rotatable flex arm, a surface of the permanent magnet resting on the flex arm, an underside of the flex arm carrying first and second electrical contacts;

a lower spacer layer beneath the flex circuit layer and having first and second openings therein separated by a thin bar upon which the flex arm rests; and a base component positioned beneath the lower spacer layer and comprising an electromagnet actuatable to rotate the flex arm clockwise or counterclockwise; and third and fourth electrical contacts positioned on the base component to respectively make electrical contact with the first and second electrical contacts when said flex arm is caused to move in a selected direction by actuation of said electromagnet.

2. The structure of claim 1 wherein said permanent magnet resides in a cavity formed in the top spacer layer.

3. The structure of claim 2 wherein the permanent magnet is contained in a plastic case.

4. The structure of claim 3 wherein the plastic case has first and second pivot arms formed on respective sides thereof.

5. The structure of claim 4 wherein said first and second pivot arms respectively reside in centrally disposed side channels of the cavity.

6. The structure of claim 4 wherein the flex arm is suspended by its respective pivot arms residing in first and second slots.

7. The structure of claim 4 wherein a back surface of the flex arm has signal traces formed thereon which run out the pivot arms to associated circuitry.

8. The structure of claim 3 wherein the plastic case and magnet float in the cavity such that the plastic case and magnet may pivot about a pivot point.

9. The structure of claim 8 configured such that when the permanent magnet flips about the pivot point, it pushes down one side of the flex arm and raises the other side.

10. The structure of claim 9 wherein said first and second pivot arms respectively reside in centrally disposed side channels of the cavity.

11. The structure of claim 10 wherein the lower spacer layer further comprises openings on either side of the thin bar which allow the flex arm to rotate therethrough.

12. The structure of claim 1 wherein the lower spacer layer further comprises openings on either side of the thin bar which allow the flex arm to rotate therethrough.

13. The structure of claim 1 wherein a top side of the flex arm is reinforced by a thin layer of copper plating formed on a Kapton layer.

14. The structure of claim 1 further comprising a longitudinal slot cut between the first and second electrical contacts.

15. The structure of claim 1 wherein the electromagnet comprises a soft iron core and a coil and further configured such that when a power pulse is applied to the coil, one end of the electromagnet will be north and the other end will be south, causing the magnetic beam formed by the flex arm and permanent magnet flip to the south end of the electromagnet, whereafter the permanent magnet is attracted to the soft iron core so as to hold the permanent magnet in place.

16. The structure of claim 1 wherein the top spacer layer is formed of FR4 printed circuit board ("PCB") material.

17. The structure of claim 16 wherein the lower spacer layer is formed of FR4 PCB material.

18. The structure of claim 1 wherein the lower spacer layer is formed of FR4 PCB material.

19. A switching device comprising:

a pivotally mounted permanent magnet;

a flex circuit layer disposed beneath the permanent magnet and comprising a rotatable flex arm, a surface of the permanent magnet resting on the flex arm, an underside of the flex arm carrying first and second electrical contacts;

a lower spacer layer beneath the flex circuit layer and having first and second openings therein separated by a thin bar upon which the flex arm rests; and a base component positioned beneath the lower spacer layer and comprising an electromagnet actuatable to rotate the flex arm clockwise or counterclockwise; and third and fourth electrical contacts positioned on the base component to respectively make electrical contact with the first and second electrical contacts when said flex arm is caused to move in a selected direction by actuation of said electromagnet.

* * * * *